US006797101B2

(12) United States Patent
Ferencz et al.

(10) Patent No.: US 6,797,101 B2
(45) Date of Patent: Sep. 28, 2004

(54) METHOD FOR PROVIDING A WEB OF THERMOPLASTIC FILAMENTS

(75) Inventors: Richard Ferencz, Isle of Palms, SC (US); Jian Weng, Charlotte, NC (US); Brian Yamanouchi, Charlotte, NC (US)

(73) Assignee: Polymer Group, Inc., North Charleston, SC (US)

( * ) Notice: Subject to any disclaimer, the term of this patent is extended or adjusted under 35 U.S.C. 154(b) by 295 days.

(21) Appl. No.: 10/072,748

(22) Filed: Feb. 7, 2002

(65) Prior Publication Data

US 2002/0074089 A1 Jun. 20, 2002

Related U.S. Application Data

(62) Division of application No. 09/301,086, filed on Apr. 28, 1999, now Pat. No. 6,386,260.

(51) Int. Cl.[7] ..... B32B 31/00
(52) U.S. Cl. ..... 156/167; 156/181; 156/296
(58) Field of Search ..... 156/167, 181, 156/433, 441, 296; 425/147.8 E

(56) References Cited

U.S. PATENT DOCUMENTS 5,225,018 A * 7/1993 Zeldin et al. ..... 156/181
5,292,239 A * 3/1994 Zeldin et al. ..... 156/167
5,397,413 A * 3/1995 Trimble et al. ..... 156/167

* cited by examiner

*Primary Examiner*—Jeff H. Aftergut
(74) *Attorney, Agent, or Firm*—Wood, Phillips, Katz, Clark & Mortimer

(57) ABSTRACT

An apparatus for providing a uniform web of filaments comprises tube filament transport means exiting through a confined zone of reduced turbulence, which preferably comprises a delivery slot. The delivery slot is configured with sidewalls substantially parallel to one another and to the transport tubes, so that filaments undergo minimal machine direction deflection in the slot. Charging means within the slot charge the filaments for further cross direction separation. A method of providing a uniform web of filaments comprises transporting filaments through transport tubes, through a tapered transition member, and into a delivery slot. The delivery slot is defined by sidewalls that are substantially parallel to one another and to the transport tubes, so that minimal machine direction deflection of the filaments occurs. The filaments are also charged by electrostatic charging means while they are in the slot for further separation. The method and apparatus of the invention provide for a uniform filament web with high machine direction orientation.

8 Claims, 3 Drawing Sheets

METHOD FOR PROVIDING A WEB OF THERMOPLASTIC FILAMENTS

This application is a divisional application of Ser. No. 09/301,086 filed Apr. 28, 1999, now U.S. Pat. No. 6,386, 260.

FIELD OF THE INVENTION

The present invention relates to a method and apparatus for providing a web of thermoplastic filaments. In particular, the present invention relates to a method and apparatus whereby a slot member is combined with an accelerator gun type tube system.

BACKGROUND OF THE INVENTION

Through a typical spunbonding process, nonwoven fabrics are made by depositing spun filaments on a moving support to form a web followed by bonding the web. Generally, the thermoplastic filaments are first continuously extruded, quenched, drawn, and attenuated by exposure to a high velocity fluid, and then deposited on the moving support. The quality of the final web depends to a great degree on the relative arrangement and uniformity of the filaments in the deposited web. The method and apparatus used for drawing and attenuating the filaments will determine their uniformity and arrangement in the web.

Manufacturers of non-wovens have made many innovations regarding such drawing and attenuating methods and apparatuses. Generally, good separation between filaments in combination with a high velocity for high rates of production is desired. When separation between filaments is poor, strands undesirably become wrapped about one another; a condition referred to as "ropiness". Ropiness in turn leads to poor uniformity in the resultant web.

Early spunbonding processes typically utilized round tubes for drawing and attenuating the filaments. High velocities of air were sent through the tubes to carry the filaments through and direct them for depositing on a moving support below to form a web. These tubes may be referred to as "Venturi tubes" or "attenuator guns", with the "Lurgi" process one system of this type (use herein of any of these terms is generally intended to be interchangeable). Systems such as these have several problems associated with them. "Gun outs" can occur when one or more filaments break at the entry point of a tube due to the aggressive handling created by the air acceleration in the tube. When a gun out occurs, unattenuated fibers and polymer drips can fall directly onto the support below. This can result in an expensive total line stoppage for cleaning of the support.

Additional problems are also associated with Lurgi tube systems. Inside the tubes the filaments make contact with other filaments, which may result in them becoming stuck together or entangled, causing a defect referred to as "ropiness". Additionally, the interior of the tubes can become partially or completely blocked due to polymer deposits resulting from drips or filaments contacting the tube inner surface. Finally, the high velocity of the air in the tubes is associated with a general non-uniform or splotchy appearance to the finished web, as the filaments are directed to the moving support with considerable force, providing little opportunity for spreading or randomization. These various problems tend to result in undesirable webs with low tensile strength.

Many attempts have been made to improve the performance of Lurgi tubes. For example, U.S. Pat. Nos. 3,163, 753; 3,341,394; and 4,009,508 describe the use of corona electrodes for charging the filaments electrostaticly in combination with use of a Lurgi tube. Electrostatic charging tends to separate the filaments and thus to decrease ropiness and to otherwise result in a more uniform web. Although this method provides some improvement, it does not achieve fully satisfactory performance.

Alternate drawing and attenuation methods and apparatuses have also been developed. In particular, U.S. Pat. Nos. 4,340,563 and 4,405,297 describe slot draw processes which replace Lurgi tubes with an elongated slot extending across substantially the whole web cross section to draw and attenuate filaments. Further advancements to the slot draw system are described in U.S. Pat. Nos. 4,578,134; 5,397,413; 5,545,371. These patents describe modifications to the slot draw process that include, respectively, a complex directed air stream, a corona treatment, and an air stream with water dispersed in it. The slot draw system in its various forms has generally resulted in improved filament drawing and attenuating for more uniform and efficient non-woven web production Lurgi tubes, however, remain in use for economic and performance related reasons. Because of the high velocity of air that is developed through the tube, tube attenuation offers superior filament crystallinity and orientation over slot draw systems, which have a lower air velocity and resultant lower crystallinity. Low crystallinity can result in low filament tenacity, and in filament shrinkage during subsequent thermal bonding. Also, because of the large capital investment required to install a slot draw system, it is not practical for many manufacturers having existing Lurgi tube systems to take advantage of the advances offered by a slot draw system.

There is therefore a need for improved Lurgi tube systems.

Prior efforts at improving such systems have included deflecting the filaments off of a deflector plate mounted below the tube outlet. While this method broadened the laydown pattern of the filaments in the web, good uniformity was not realized. Another effort included mechanically oscillating one or more of the tubes, deflector plates, and/or the web. These methods, however, were found to depend on the operating frequency of the oscillating member(s), and also entailed numerous related maintenance problems.

Another proposed improvement to the Lurgi tube systems is described in U.S. Pat. No. 5,225,018 to Zeldin et al. Zeldin attaches a pair of tapered guide plates to a row of Lurgi tubes to form a slot at the outlet of tubes prior to depositing filament on the web. The plates are slanted at a precise angle so that turbulent air flow is developed in the tapered slot formed between the plates. As the filaments exit the tubes and enter the tapered slot, they are randomly spread by the turbulent air flow that exists in the slot. Zeldin further includes corona means below the outlet of the tapered slot for additional filament separation. Zeldin's device results in relatively randomly deposited filaments across the width of the web, with a high ratio of cross direction filament depositing to machine direction filament depositing.

The apparatus of Zeldin, however, leaves many problems with using Lurgi tubes unresolved. Due to the high cross direction machine direction ratio that webs have when produced using the apparatus of Zeldin, for instance, Lurgi tubes are still unable to be used for production of a relatively uniform web with a high machine direction orientation and low machine direction elongation.

There is therefore an unresolved need in industry for an improved apparatus and method for producing a uniform web of continuous filaments with high machine direction strength, and high crystallinity.

OBJECTS OF THE INVENTION

It is an object of the invention to provide an apparatus and method for the production of a uniform web of filaments having high crystallinity, and high machine direction orientation.

SUMMARY OF THE INVENTION

The present invention generally comprises an apparatus and a method for providing a uniform web of non-woven filaments having high crystallinity, high machine direction orientation, and low machine direction elongation.

The apparatus of the present invention generally comprises filament transport means having an exit, with a confined zone of reduced turbulence adjacent to the transport means exit. As the filaments exit the transport means conveyed through the confined zone where the conveying fluid velocity slows and turbulence is reduced, thus spreading the filaments in a cross direction.

The transport means preferably comprise a plurality of Lurgi tubes, while the preferred confined zone comprises a delivery slot defined by a slot member. The tube exits are located adjacent to the elongated delivery slot. The preferred delivery slot is defined by the substantially parallel first and second sideplates and substantially parallel endplates of the slot member. The sideplates and endplates are also parallel to the transport means. Preferably, a tapered transition member is between the tube exit and delivery slot entrance to aid in introduction of the filaments to the slot. The high velocity fluid flow coming out of the tubes slows in the larger slot, allowing for spreading of the filaments and discouraging ropiness. As the filaments travel through the tapered transition member, they are spread in a cross direction along the elongated delivery slot. Because the sidewalls are substantially parallel to one another and to the Lurgi tubes, the filaments travel through the delivery slot without significant machine direction deflection, thereby minimizing randomization (herein defined as machine direction deflection) and providing high machine direction orientation.

The preferred apparatus of the invention further comprises electrostatic charging means in one of the first or second side plates for electrostatically charging the filaments with like charges as they travel through the delivery slot. The effect of having like surface charges on the filaments is to have the filaments physically repel one another. The charged filaments are thus further separated, thereby discouraging and even correcting filament ropiness. Preferred electrostatic charging means comprise corona discharge pins in one of the first or second sideplates extending along the length of the plate.

The preferred discharge pins are positioned inside the throat of the slot, so that the filaments are spread while still in the slot. In this manner, the majority machine direction orientation of the filament curtain is maintained, rather than encouraging a cross direction randomization that would result should the filaments be charged after exiting the slot.

The apparatus of the invention may further preferably comprise means for pneumatically carrying filament through the transport means and delivery slot, a moving support member traveling below the delivery slot to receive the deposited web, and bonding means for bonding the deposited web.

The method of the present invention comprises the sequential steps of transporting filaments through transport means, which preferably comprise Lurgi tubes, and transporting them through a confined zone of reduced turbulence. The filaments are spread in a cross direction as they travel through the confined zone. The preferred confined zone comprises a delivery slot defined by substantially parallel first and second sidewalls, which are also substantially parallel to the Lurgi tubes. The filaments thus travel through the preferred delivery slot with minimal randomization, while spreading uniformly into a filament curtain in a cross direction. Preferably, the filaments are transported through a tapered transition member between the transport means and the delivery slot for further cross direction spreading of the filament curtain. Also, the filaments are preferably electrostatically charged with like charges while traveling through the delivery slot so that the individual filaments will repel one another and be further separated both within the slot and while traveling between the slot and the moving support below.

The filaments are preferably transported pneumatically by air through the Lurgi tube and delivery slot. Also, the method of the invention further comprises preferred steps of depositing the web on a moving support below the slot, and subsequently bonding the deposited web.

Using the method and apparatus of the invention, a significantly improved cross direction spreading of filaments is achieved as compared to use of Lurgi tubes alone. Because of the substantially parallel apparatus side and end plates, minimal filament deflection in the machine direction occurs through the delivery slot. The method and apparatus of the present invention thus result in a deposited web with high machine direction orientation and low machine direction elongation, while having greatly improved cross direction uniformity over use of Lurgi tubes alone. This is a result not possible using a tapered slot. Further, the high fluid velocity possible in the tube transport of the present invention results in improved filament crystallinity over conventional slot draw attenuators. The method and apparatus of the present invention therefore resolves a heretofor unresolved need in industry in a facile and efficient manner.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining the embodiments of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

DETAILED DESCRIPTION

Figure 1:
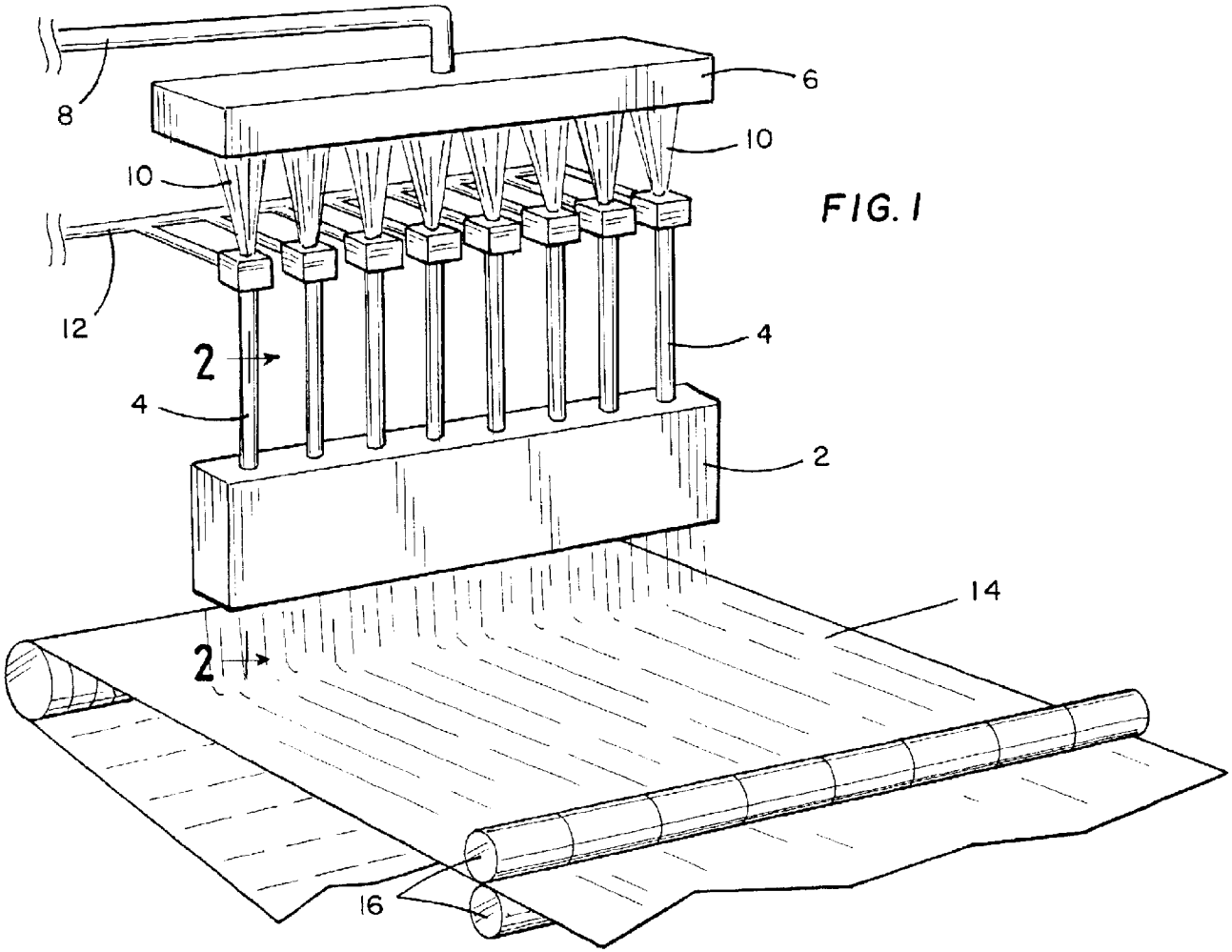
FIG. 1 is a perspective view of a preferred embodiment of the apparatus of the invention.

Turning now to the drawings, FIG. 1 is a perspective view of a preferred apparatus of the invention, generally comprising slot member 2 attached to a plurality of transport tubes 4. The apparatus and method of the invention are suitable for use with transport means that include, but are not limited to, tubes that may be interchangeably referred to as Venturi tubes or gun attenuators. One of the more common systems utilizing such tubes is a Lurgi system. For purposes of illustration, reference within this disclosure is made to a Lurgi system with Lurgi tubes, but this should not be interpreted as a limitation on the apparatus or method of the present invention. It is also noted that FIG. 1 illustrates the invention with eight Lurgi tubes; again, this is for illustration only, and not for limitation. The apparatus and method of the invention may comprise a lesser or greater number of transport tubes.

Continuous filaments are fed to tubes 4 from an extruder beam 6 above. Molten thermoplastic polymer, which preferably comprises a polyolefin, polyamide, or a polyester, is fed to the extruder through line 8, and a plurality of individual filaments 10 are extruded through a plurality of orifices in extruder beam 6 into tubes 4. High pressure air is fed to tubes 4 by line 12. Air is directed downwards through tubes 4 to draw filaments 10. Preferably, air flows at a rate in the range of 6,000–9,000 m/min , as measured at the tube outlet. These air speeds have been found to convey the filaments at the preferred rate of between 2,000 to 3,000 m/min.

FIG. 1 also shows preferred support 14 moving below slot member 2, with a continuous filament web (shown in broken line) being deposited on moving support 14. The preferred distance between slot member 2 exit and support 14 is between 290–450 mm. The speed of support 14 may vary as may be desired to vary the bulk of the deposited web. Generally, the line speed of support 14 of the invention may be as is generally practiced in industry. FIG. 1 also shows heated calender rollers 16 for thermally bonding the deposited web.

Figure 2:
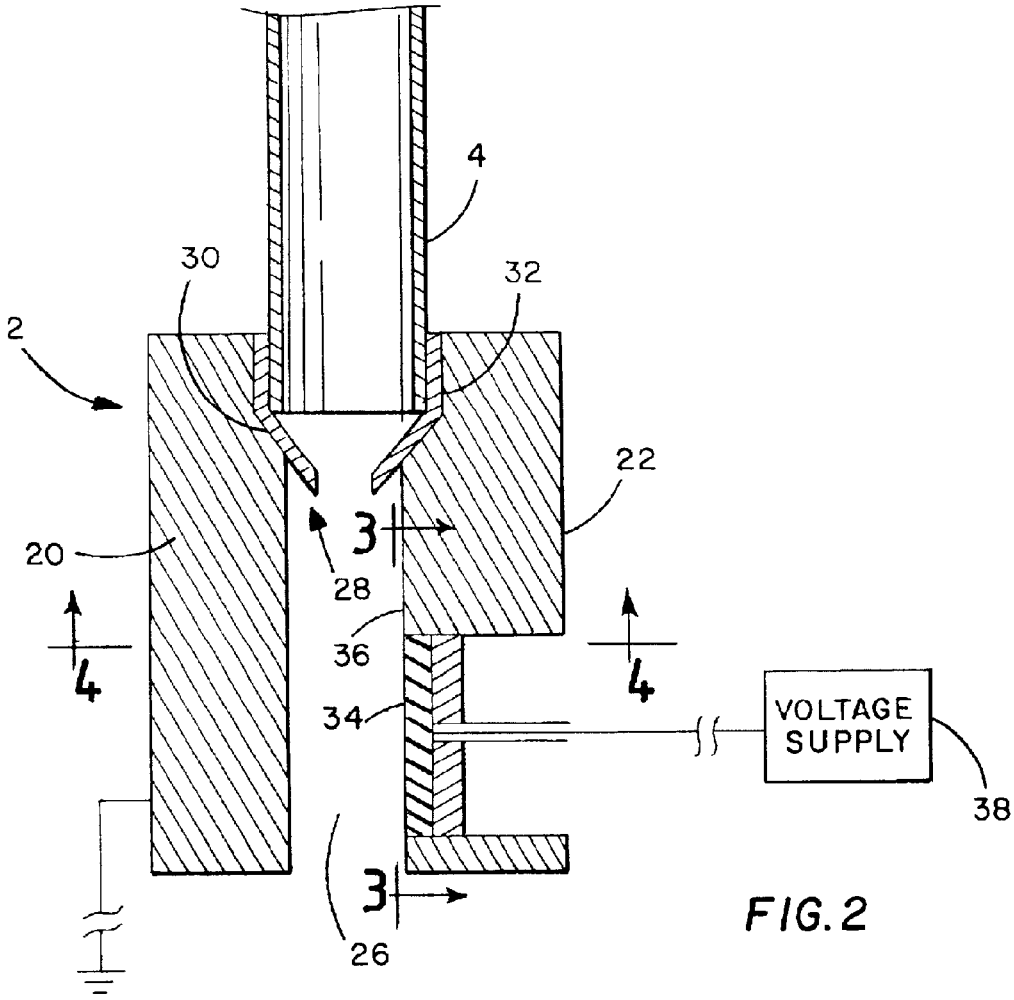
FIG. 2 is a cross section elevational view of the preferred embodiment of the apparatus of the invention.

FIG. 2 is a cross section of the preferred apparatus of the invention. Sideplates 20 and 22 are substantially parallel to one another, and to Lurgi tube 4. Sideplates 20 and 22 are preferably thick to resist bending, flexing, or other distortions, and so that substantially flat sideplates 22 and 24 may be easily fabricated. Delivery slot 26 is formed between sideplates 20 and 22. Transition member 28, which is comprised of tapered transition plates 30 and 32, is between Lurgi tube 4 exit and delivery slot 26. Lurgi tube 4 and tapered plates 30 and 32 are preferably threaded for connection. Sideplates 20 and 22 may be joined at their top between Lurgi tubes to cover delivery slot 26 (not shown in FIG. 2); delivery slot 26 may also, however, be open at its top. Also, sideplates 20 and 22 may be held together by means as are generally known, including by screws. Endplates may cover respective ends of delivery slot 26, but are again not required. Should endplates be provided, they are preferably substantially parallel to one another and to Lurgi tube 4.

The preferred apparatus of FIG. 2 also comprises electrostatic charging member 34 installed in sideplate 22 such that it is substantially flush with sideplate interior surface 36. Charging member 34 is connected to a voltage source 38, and sideplate 20 is connected to ground. To aid in good charge transfer, as well as to achieve the flow characteristics useful for the invention, the width of slot 26 is preferably narrower than the diameter of Lurgi tubes 4.

Figure 3:
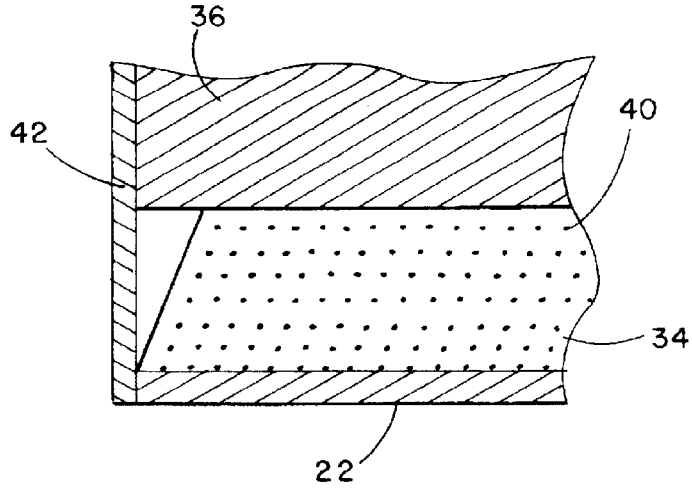
FIG. 3 is a partial cross section elevational view of the electrostatic charging means of the preferred embodiment of an apparatus of the invention.

FIG. 3 is a partial cross sectional view of preferred charging member 34 flush with sideplate 22 surface 36. Charging member 34 preferably comprises a plurality of individual corona charging pins 40 arranged in an offset grid for improved charging and separation in a cross direction of filaments as they pass by member 34. Individual charging pins 40 are insulated from one another and from sideplate 22. FIG. 3 also shows endplate 42 attached to the end of sideplate 22 for covering an end of delivery slot 26 of FIG. 2.

Figure 4:
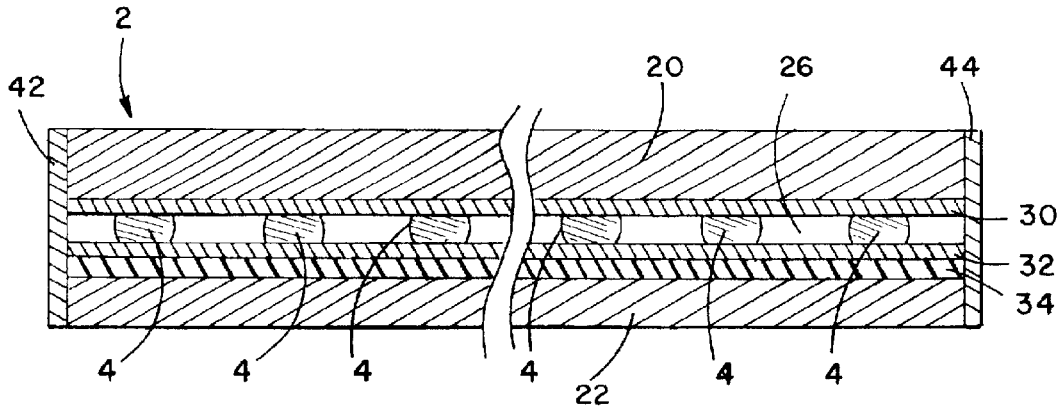
FIG. 4 is a partial cross section bottom view of the preferred embodiment of the invention.

FIG. 4 is a cross sectional view of the apparatus of the invention taken along the line 4—4 of FIG. 2. As discussed infra, sidewalls 20 and 22 are substantially parallel to one another and to Lurgi tubes 4. Tapered transition plates 30 and 32 run the length of delivery slot 26, and are between Lurgi tubes 4 and delivery slot 26. Electrostatic charging member 34 is installed in sidewall 22 for charging filaments as they pass through delivery slot 26. FIG. 4 also shows preferred endplates 42 and 44 attached to respective ends of sideplates 20 and 22. Endplates 42 are substantially parallel to one another and to Lurgi tubes 4.

As filaments flow out of Lurgi tubes 4 and into delivery slot 26, they are only a slightly deflected in a machine direction by tapered transition member 28, but are substantially spread out in a cross direction along the length of delivery slot 26. This provides for much improved uniform spreading of the filaments in a cross direction as opposed to use of Lurgi tubes alone. The velocity of the fluid carrying the filaments through Lurgi tubes 4 slows through slot 26, thereby discouraging ropiness and even allowing for entangled filaments to disentangle. As the filaments pass charging member 34 they are charged with like charges, and thereby physically repel one another; further separating themselves uniformly in a cross direction.

Because endplates 42 and 44 and sideplates 20 and 22 are all substantially parallel to one another and to Lurgi tubes 4, the filaments pass from Lurgi tubes 4 and through delivery slot 26 substantially without machine direction disturbance. This discourages the kind of turbulence in delivery slot 26 that is developed in a tapered slot. Such turbulence tends to result in a random web with low machine direction to cross direction ratio, and is therefore undesirable for producing a web of high machine direction orientation. Also, the charging member 34 of the present invention charges filaments as they pass within slot 26. This is likewise advantageous for producing a web of high machine direction orientation.

It is also noted that the objects of the invention may likewise be achieved with sidewalls 22 and 24 having an outwardly tapered orientation, although the parallel orientation is preferred.

A preferred method of the present invention comprises the sequential steps of transporting filaments through Lurgi tubes, through a tapered transition member, and into a delivery slot. The delivery slot has substantially parallel first and second sidewalls, which are also substantially parallel to the Lurgi tubes. Preferably, the slot has a width (in the machine direction) that is narrower than the individual tube diameters. Because of the slot orientation and parallel sidewalls, the filaments travel from the Lurgi tubes and through the delivery slot with only minimal machine direction deflection, but with substantial cross direction spreading. Also, the filaments are electrostatically charged by a plurality of corona charging pins while traveling through the delivery slot so that the individual filaments will repel one another and will be further separated in a cross direction. The filaments are finally deposited on a moving support below the delivery slot to form a web. The preferred method of the invention further comprises depositing the web on a moving support below the slot, and bonding the deposited web.

The apparatus and method of the present invention thereby take advantage of the high fluid velocity of tube transport for its beneficial effects on crystallinity and throughput volume, while also taking advantage of the decreased filament ropiness and increased cross direction uniformity provided by the delivery slot.

The advantages of the disclosed invention are thus attained in an economical, practical and facile manner. While preferred embodiments have been shown and described, it is to be understood that various further modifications and additional configurations will be apparent to those skilled in the art. It is intended that the specific embodiments herein disclosed are illustrative of the preferred and best modes for practicing the invention, and should not be interpreted as limitations on the scope of the invention as defined by the appended claims.

What is claimed is:

1. A process for providing a uniform web of thermoplastic filament, comprising the sequential steps of:

(a) transporting spun filaments through a plurality of filament transport tubes into a confined zone of reduced turbulence; and (b) transporting the filaments through said confined zone with minimal machine direction deflection from said plurality of transport tubes, said filaments thereby being spread and separated in said confined zone by forming a thin layer of the filaments along the length of the confined zone, said confined zone defined by a pair of opposing sideplates and a pair of opposing endplates attached to the ends of said sideplates, said sideplates substantially parallel to one another, endplates substantially parallel to one another, said sideplates and said endplates substantially parallel to said plurality of transport tubes.

2. A process as in claim 1, further comprising the step of depositing said filaments layer on a moving support below said confined zone.

3. A process as in claim 2, further comprising the step of bonding said deposited filament layer.

4. A process for providing a uniform web of thermoplastic filaments as in claim 1, wherein said confined zone comprises a filament delivery slot.

5. A process as in claim 1, further comprising the step of transporting the filaments through a tapered transition member between said transport means and said confined zone.

6. A process as in claim 1, further comprising the step of applying an electrostatic charge to the filaments within said confined zone to further separate the filament.

7. A process as in claim 1, wherein said filaments are transported via pneumatic means.

8. A process as in providing a uniform web of thermoplastic filaments, comprising the sequential steps of a) pneumatically transporting spun filaments through a plurality of filament transport tubes into a tapered transition member, said transport tubes having a diameter;

b) transporting said filaments through said tapered transition member into a delivery slot, said delivery slot defined by a pair of opposing sideplates and a pair of opposing endplates attached to the ends of said sideplates, said sideplates substantially parallel to one another, said endplates substantially parallel to one another, said sideplates and said endplates substantially parallel to said transport tubes, said delivery slot having a width defined by the distance between said sideplates, said width narrower than said tube diameter;

c) transporting the filaments through said delivery slot with minimal machine direction deflection from said transport tubes and transition member, said filaments spread and separated in a cross direction in said delivery channel by forming a layer of the filaments along the length of the elongated delivery slot; and d) electrostatically charging the filaments within said delivery channel for further separation and spreading.

* * * * *